US005724672A

United States Patent [19]

Chen

[11] Patent Number: 5,724,672

[45] Date of Patent: Mar. 10, 1998

[54] MULTI-PURPOSE BAG

[76] Inventor: Kui-Sen Chen, No.1, Lane 356, Hsing-Hsueh St., Hsi-Hu Chen, Changhua Hsien, Taiwan

[21] Appl. No.: 665,373

[22] Filed: Jun. 18, 1996

[51] Int. Cl.[6] ..... A41D 1/22; B65D 30/00

[52] U.S. Cl. ..... 2/69; 2/105; 383/4

[58] Field of Search ..... 2/69, 69.5, 85, 2/86, 88, 89, 93, 94, 102, 105, 106, 108, 211, 213; 383/4, 38–40, 75

[56] References Cited

U.S. PATENT DOCUMENTS

| | | | |
|---|---|---|---|
| 4,475,251 | 10/1984 | Hopkins | 2/94 |
| 4,476,587 | 10/1984 | Itoi | 2/94 |
| 5,165,111 | 11/1992 | Lieberman | 2/94 |
| 5,526,969 | 6/1996 | Greenberger | 2/94 X |

*Primary Examiner*—Gloria Hale
*Attorney, Agent, or Firm*—Browdy and Neimark

[57] ABSTRACT

A convertible shoulder bag structure which, besides the double functions of carrying either on one shoulder or both shoulders, can also be converted into a dress or be stored up in a little pocket for easy carrying. The shoulder bag structure is provided with a belt seamed at both front and rear pieces of the bag body respectively, each provided with an adjusting buckle to adjust the length thereof; a metallic string hole disposed at the rear piece of the bag body for a string enveloped along the upper edge of the bag body to pass therethrough and to attach to a closed ring body of a fastening hook; a zipper member extending along the right side edge, the bottom edge, and the lower section of the left side edge, permitting the shoulder bag to convert into a dress: a pair of adjusting belts permitting the adjustment of the size of the dress converted from a shoulder bag; and a reversible pocket having a hi-directional zipper member and a holding ear, permitting the bag body folded up to be stored therein for easy carrying. Also, the convertible shoulder bag structure can serve especially for children, having a little pocket seamed around its four edges with a little zipper set so as to zipper up the bag body of the shoulder bag into a little pocket for easy carrying.

2 Claims, 5 Drawing Sheets

MULTI-PURPOSE BAG

BACKGROUND OF THE INVENTION

1. Technical Field of the Invention

The present invention relates to a multi-purpose bag, especially to a bag structure which, in addition to the double function of carrying either on one shoulder or on both shoulders, can be converted into a dress or be stored in a little pocket for easy carrying.

2. Prior Art

Please refer to FIGS. 9-A, 9-B, 9-C showing a conventional convertible coat structure which can be changed from a coat into a shoulder bag. Yet, there are several drawbacks existing in such a conventional convertible coat structure. First, to convert the coat into a shoulder bag, the zipper member 2 is zippered up, enclosing all of the front piece of the coat 1 within the interior of the bag body 8. Besides, a handle 4 is disposed transversely at the opening of the bag body 8, inconveniently hindering the placing or taking of articles in/out of the bag body 8. Second, when the coat 1 unconverted is worn by a wearer, a belt 3 is adapted to tie up the coat like a night gown. The front side of the coat 1 cannot then remain in one piece and the appearance of the coat 1 in front and rear are also quite different in style, which all make a wearer quite uncomfortable when wearing it. Moreover, the teeth of the zipper members 2 are exposedly disposed at almost both lateral sides of the coat 1, extending from the shoulder downward to the bottom of the coat 1. Third, the convertible coat structure has no other option other than a coat or a shoulder bag, lacking any little pocket to accomodate more articles or to store up the coat or shoulder bag for easy carrying.

SUMMARY OF THE PRESENT INVENTION

It is therefore the primary object of the present invention to provide a convertible shoulder bag structure, which can be alternatively changed in way of carrying on either one shoulder or both shoulders and provided with nothing particular like a handle at the opening of the bag body to hinder the carrying of articles.

It is another object of the present invention to provide a convertible shoulder bag structure, which can be converted from a shoulder bag into a dress by a zipper member with a front side in one piece and a back side adjusted by belts and buckles to loosen or tighten the dress so as to fit wearers of different sizes.

It is a third object of the present invention to provide a convertible shoulder bag structure, having a reversible pocket adapted to accomodate more articles or to store up the bag body or the dress for easy carrying.

DETAILED DESCRIPTION OF THE PREFERRED EMBODIMENTS

Figure 1:
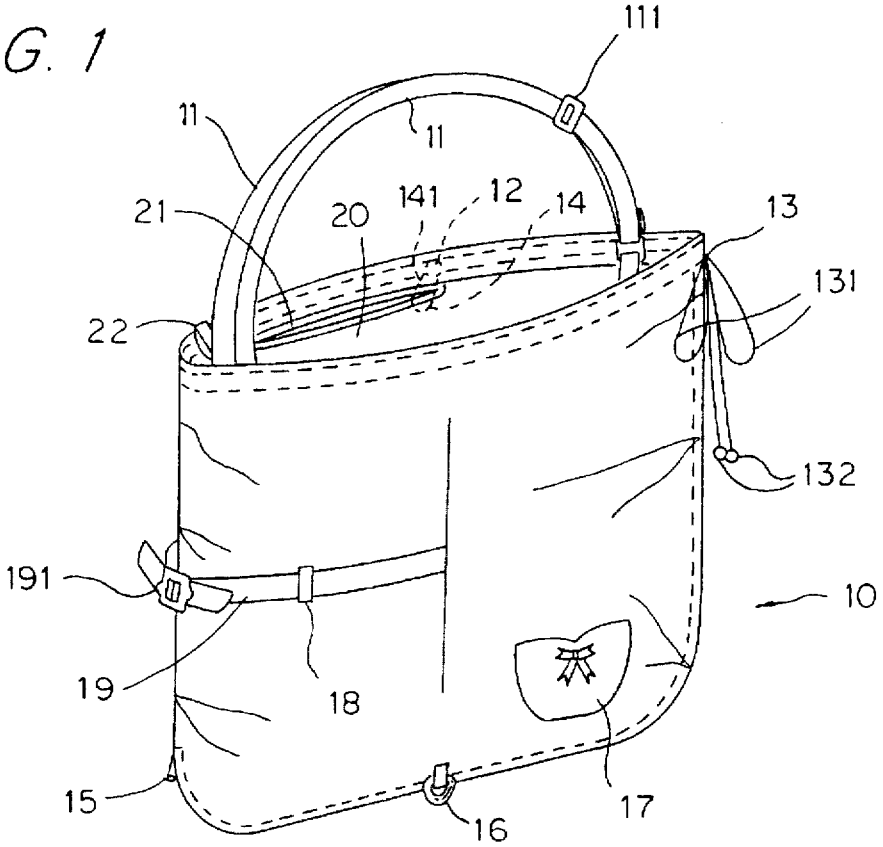
FIG. 1 is a perspective view of the present invention.

Please refer to FIG. 1. The present invention relates to a convertible shoulder bag structure comprising a bag body 10 seamed at the interior upper lateral sides of both front and rear pieces thereof with a belt 11 respectively, each provided with an adjustable buckle 111 to adapt the length of the belt 11. A metallic string hole 12 is provided at the upper middle section of the rear piece of the bag body 19 for a string 13 enveloped along the upper edge of the bag body 10 to pass therethrough and then to attach to a closed ring body 141 of a fastening hook 14. Both ends of the string 13 are suspended out of the right side upper edge of the bas body 10 to tie up in a slip knot 131, and ended with a cap 132 respectively. A zipper member 15 is disposed, extending along the right side edge, the bottom edge and the lower section of the left side edge of the the bag body 10. A fastening ring 16 is provided at the bottom middle edge of the front piece of the bag body 10. A pair of little pockets 17 for decoration are provided at the lower right side of the front piece and the other side of the rear piece of the bag body 10 each corresponding to the other. A pair of belt rings 18 are seamed to the middle section of the front left side and that of the rear other side of the bag body 10 each corresponding to the other. Two adjusting belts 19 are seamed to the middle section of the front and rear pieces of the bag body 10 at one end respectively, passing through the belt rings 18 respectively and attached to an adjusting buckle 191 from both sides at the other end respectively. A reversible pocket 20 having a set of bi-directional zipper members 21 at the opening and a holding ear 22 at one interior lateral side is disposed at the interior upper edge of the rear piece of the bag body 10.

Figure 2:
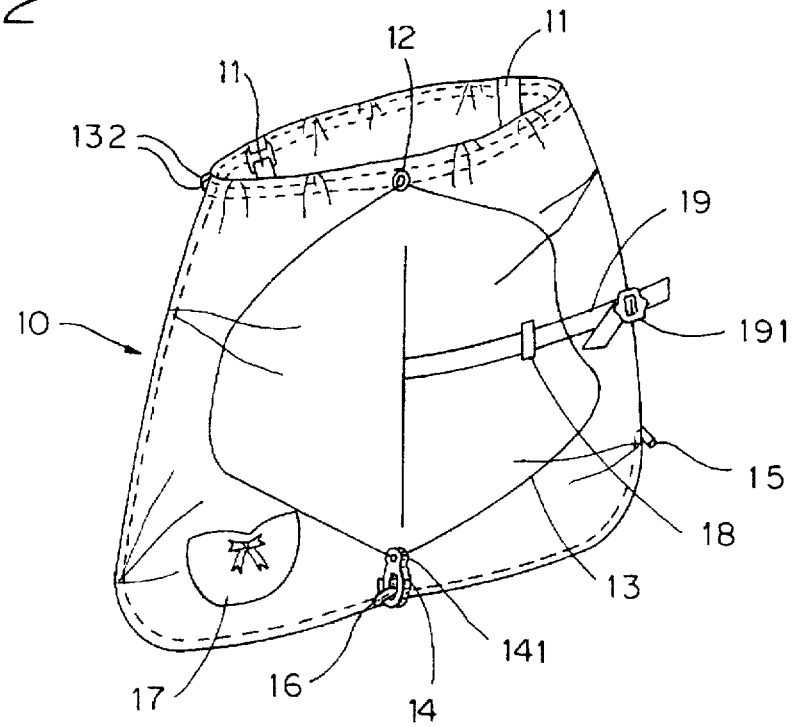
FIG. 2 is a perspective view of the present invention changed in way of carrying from one shoulder to both shoulders.

Please refer to FIG. 2. To change the way of carrying the shoulder bas from one shoulder to both shoulders, the belts 11 of the bag body 10 are first placed into the bag body 10. The fastening hook 14 is then pulled downwards, carrying along the string 13 attached to the closed ring body 141 of the fastening hook 14 which, released from the slip knot 131, is then drawn downwards through the metallic string hole 12 till the caps 132 at both ends of the string 13 are stopped at the right side upper edge of the bag body 10, thus righting and binding close the opening of the bag body 10. The fastening hook 14 can then be attached to the fastening ring 16, and the string 13 drawn out of the metallic string hole 12 can be used as belts to be carried on both shoulders.

Figure 3A:
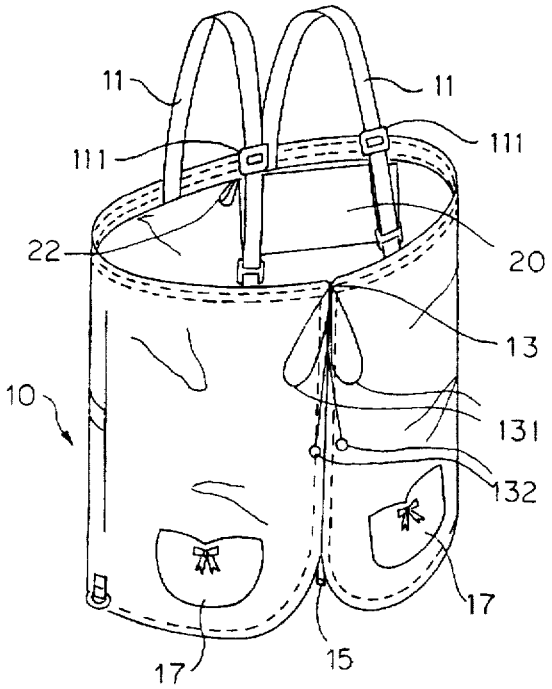
FIGS. 3A & B are front and rear side views of the dress converted from the shoulder bag of the present invention.
Figure 3B:
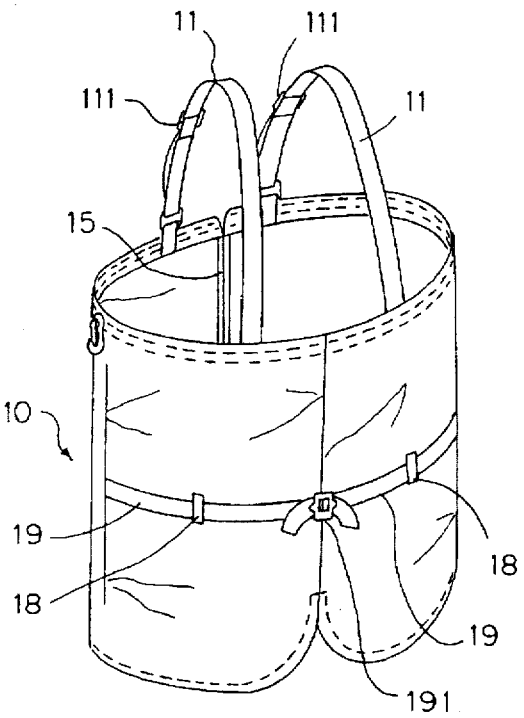

Please refer to FIG. 3. To convert the shoulder bag into a dress, the zipper member 15 is first slid open from the lower section of the left side edge and the bottom edge to the right side edge. The slip knot 131 at both ends of the string 13 is released. And the lateral side of the bag body 10 disposed with the slip knot 131 of the string 13 is then turned into the front side of the dress converted from the shoulder bag. The belts 11 can become suspenders of the dress with the adjusting buckles 111 disposed on the belts to adjust the proper length of the suspenders for wearing. The zipper member 15 disposed at the front side of the dress is then zippered down and the slip knot 131 at both ends of the string tied up again. To adjust the size of the dress to different wearers, the adjusting belts 19 disposed at the rear side of the dress can be adapted to tighten or loosen the dress by means of the adjusting buckle 191.

Figure 4:
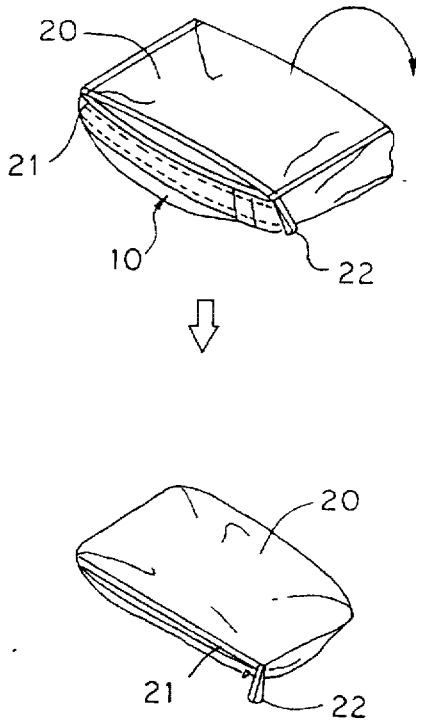
FIG. 4 is an operational view of the present invention stored up into a reversible pocket.

Please refer to FIG. 4. To store the shoulder bag 10 into little pocket, the reversible pocket 20 of the bag body 10 is first reversed from the inside out. The bag body 10 is then folded up carefully into the size the reversible pocket 20. The reversed pocket 20 is then returned back to its normal status so as to store the folded-up bag body 10 therewithin. The holding ear 22 disposed at the interior lateral side of the reversible pocket 20 is pulled out for holding and the hi-directional zipper member 21 is then zippered up to facilitate the storage of the bag body 10 within a little pocket 20 for easy carrying.

Figure 5:
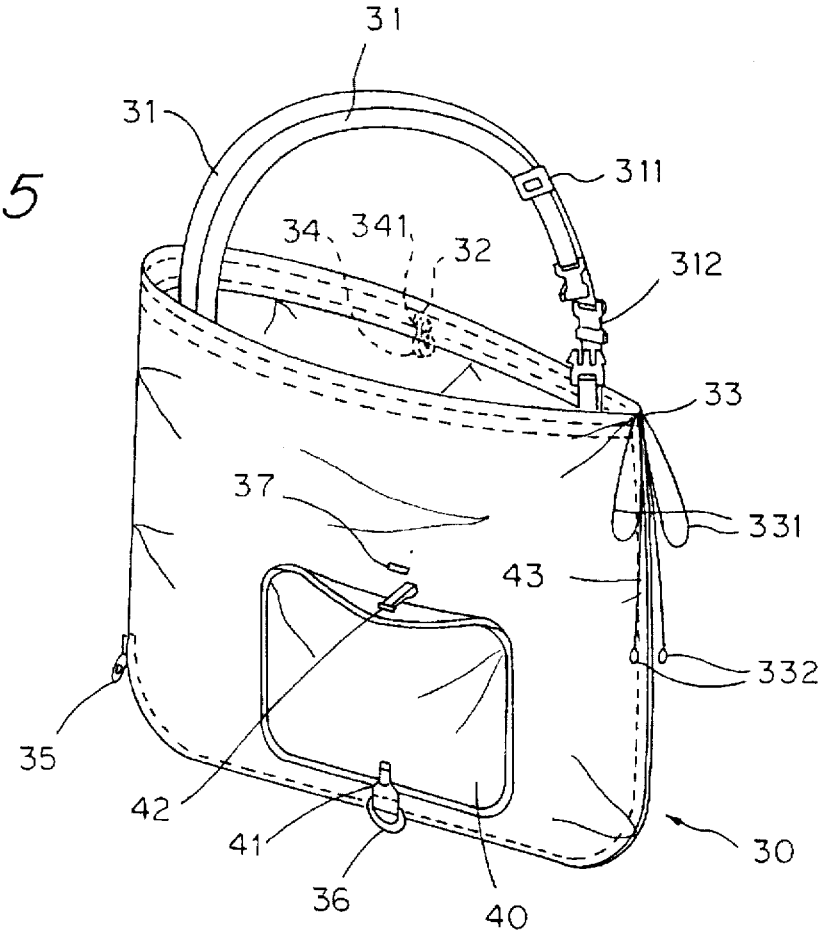
FIG. 5 is a perspective view of the present invention in another embodiment.

Please refer to FIG. 5, showing another embodiment of the present invention. The present invention relates to a convertible shoulder bag which can further serve for use of children. The convertible shoulder bag for children is made up of a bag body 30 seamed at the interior upper lateral sides of both front and rear pieces with a belt 31 respectively, each provided with an adjusting buckle 311 to adjust the lenghth of the belt 31 and an insert buckle set 312. A metallic string hole 32 is disposed at the middle upper edge of the rear piece of the bag body 30 for a string 33 enveloped along the upper edge of the bag body 30 to pass therethrough and to be attached to a closed ring body 341 of a fastening hook 34. Both ends of the string 33 are suspended out of the right side upper edge of the bag body 30 to tie up in a slip knot 331 and ended with a cap 332 respectively. A zipper member 35 is disposed, extending along the right side edge, the bottom edge, and the lower section of the left side edge of the bag body 30. A fastening ring 36 is disposed at the bottom middle edge of the front piece of the bag body 30. A little pocket 40 is seamed at the lower middle section of the front piece thereof, providing with a little zipper set 41 seamed around the four edges thereon. A first adhesive belt 42 and a holding ear 43 are disposed at the interior upper middle edge of the little pocket 40. A second adhesive belt 37 corresponding to the first adhesive belt 42 is disposed at the front piece of the bag body 30. Said first and second adhesive belts can be fastened together so as to close the opening of the little pocket 40.

Figure 6:
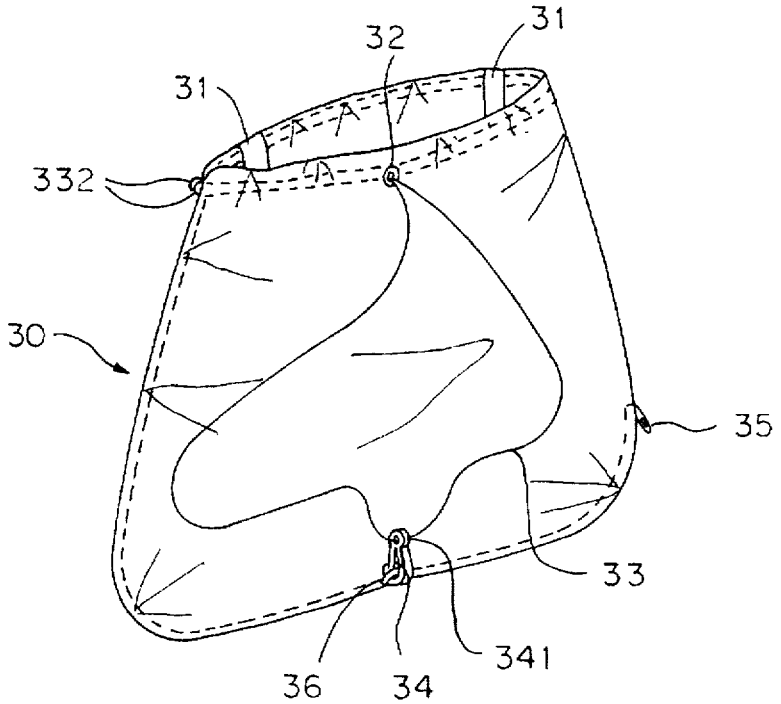
FIG. 6 is a perspective view of the other embodiment changed in way of carrying from one shoulder into both shoulders.

Please refer to FIG. 6. To change the way of carrying the shoulder bag for children from one shoulder into both shoulders, the belts 31 is first placed into the bag body 30. The fastening hook 34 is then pulled downwards, carrying along the string 33 which, released from the slip knot 331, can be drawn downward through the metallic string hole 32 till the caps 332 of the string 33 are stopped at the right side upper edge of the bag body 30, thus tightening and bounding close the opening of the bag body 30. The fastening hook 34 can be attached to the fastening ring 36, and the string drawn out of the metallic string hole 32 can be used as belts to be carried on both shoulders.

Figure 7:
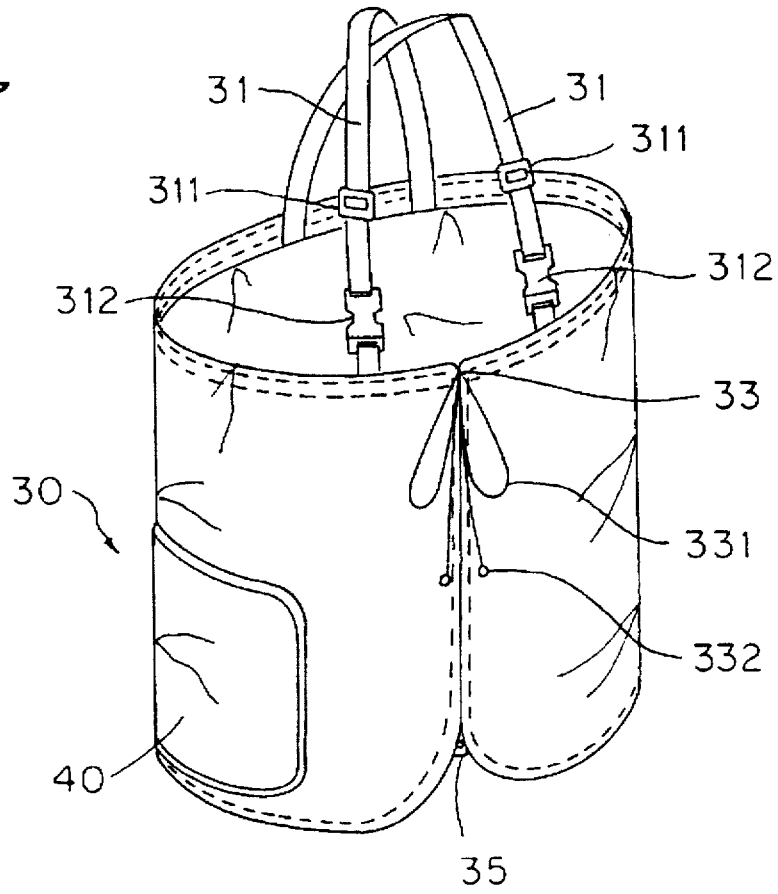
FIG. 7 is a perspective view of the other embodiment converted into a dress.

Please refer to FIG. 7. To convert the shoulder bag for children into a dress, the zipper member 35 is first slided open from the lower section of the left side edge and the bottom edge till the right side edge of the bag body 30. The slip knot 331 at both ends of the string 33 is released. And the side of the bag body 30 disposed with the slip knot 331 is turned into the front side of the dress converted from the shoulder bag. The belts 31 can be used as suspenders with the adjusting buckles 311 adapted thereon for adjusting the lenghth of the suspenders and the insert buckle set 312 for crisscrossing the suspenders at the back for wearing. The zipper member 35 disposed at the front side of the dress can be zippered down and the slip knot 331 at both ends of the string 33 tied up again.

Figure 8:
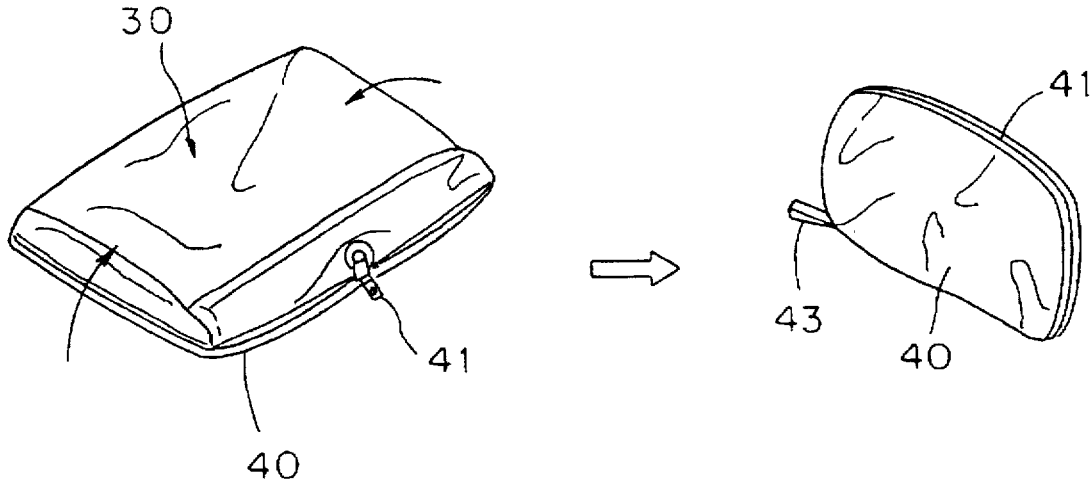
FIG. 8 is an operational view of the other embodiment stored into a little pocket.
Figure 9A:
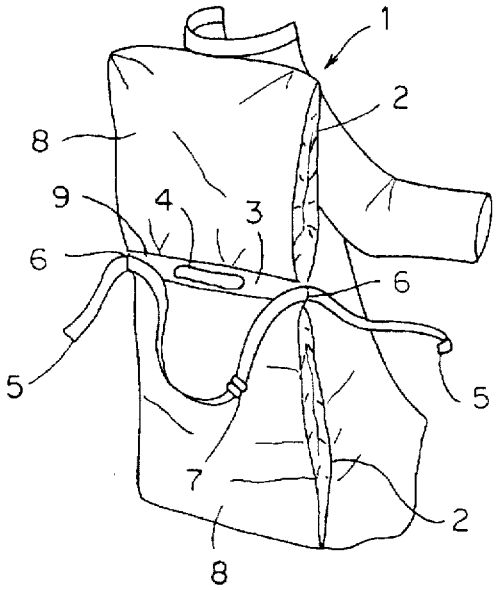
FIG. 9A PRIOR ART
FIGS. 9-A–C are perspective views of a conventional convertible coat structure.
Figure 9B:
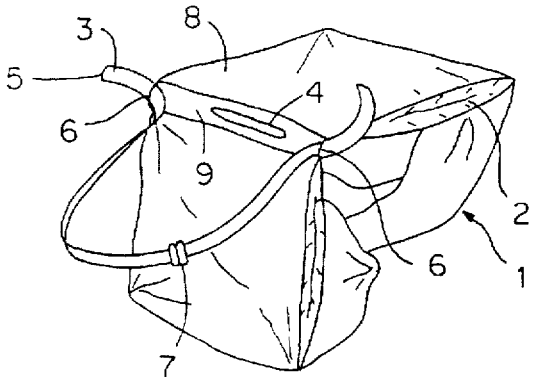
FIG. 9B PRIOR ART
Figure 9C:
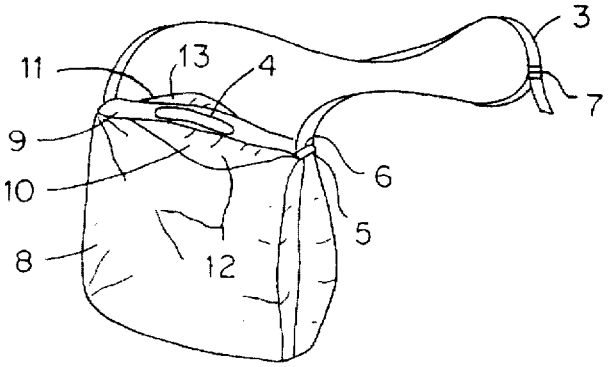
FIG. 9C PRIOR ART

Please refer to FIG. 8. To store the shoulder bag for children into a little pocket, the bag body 30 is first folded up backwardly into the size of the little pocket 40 and overlayed upon the little pocket 40. The little pocket 40 is then folded up into two halves, enclosing the folded-up bag body 30 therewithin. The first fastening belt 42 disposed at the little pocket 40 is then detached from the second fastening belt 37, and the holding ear 43 is pulled out of the little pocket 40 from the inside out. Finally the little zipper set 41 seamed around the four edges of the little pocket 40 is zippered up to store the bag body 30 of the shoulder bag therewithin the little pocket 40 for easy carrying.

Therefore, there are several advantages inherent in the present invention as shown in the above embodiments. First, nothing particular like a handle is seamed within the space of the bag body, permitting more space and convenience for carrying articles. Second, when the shoulder bas is converted into a dress, the front side of the dress is still in one piece and the size of the dress can be adjusted via the adjusting belts and buckles to meet different size of the wearers. Third, a fastening hook and a fastening ring are disposed so as to change the way of carrying the shoulder bag from one shoulder into both shoulders easily. Fourth, a reversible pocket and two little pockets for decoration or a little pocket is provided so as to enhance the room for accommodating more articles. Fifth, the reversible pocket provided with a holding ear for holding the pocket can easily store up the shoulder bag into a small pocket for easy carrying.

What is claimed is:

1. A structure convertible to a dress or a shoulder bag, comprising a bag body having a pair of belts whose ends are respectively engaged to an interior of an upper lateral side on a front and a rear piece of the bag body, an adjusting buckle to adjust a length of each of said pair of belts; wherein, a metallic string hole is provided on an upper middle section of the rear piece of the bag body for a string enveloped along the upper lateral side of the bag body to pass therethrough and to attach to a closed ring body of a fastening hook; both ends of said string being ended with a cap, said ends respectively suspended out of a right side of the upper lateral side of the bag body to enable being tied up in a slip knot;

a zipper member is disposed, extending from a right side edge and a bottom edge to a lower section of a left side edge of the bag body;

a fastening ring is disposed at a lower middle section of the front piece of the bag body for attaching the fastening hook when drawn downwards;

a pair of little pockets for decoration are provided at a right lower side of the front piece and an opposite lower side of the rear piece of the bag body;

a pair of belt rings are disposed at a left middle section of the front piece and an opposite middle section of the rear piece of the bag body, a pair of adjusting belts are respectively disposed at a left side of the front piece and an opposite side of the rear piece of the bag body, each engaged at a first end to the bag body and, passing through a belt ring of said belt rings, and attached to an adjusting buckle at a second end to adjust the size of the dress when converted from the bag body;

a reversible pocket having a bi-directional zipper member at an opening and a holding ear at a lateral side is provided at an interior upper edge of the rear piece of the bag body, the reversible pocket used to store the bag body for easy carrying;

whereby, the bag body when not stored in the reversible pocket has a double function of being convertible and supportable by said pair of belts as the shoulder bag or the dress.

2. A structure convertible to a dress or a shoulder bag, comprising a bag body having a pair of belts whose ends are respectively engaged to an interior of an upper lateral side on a front and a rear piece of the bag body, an adjusting buckle to adjust a length of each of said pair of belts; wherein, a metallic string hole is provided on an upper middle section of the rear piece of the bag body for a string enveloped along the upper lateral side of the bag body to pass therethrough and to attach to a closed ring body of a fastening hook; both ends of said string being ended with a cap, said ends respectively suspended out of a right side of the upper lateral side of the bag body to enable being tied up in a slip knot;

a zipper member is disposed, extending from a right side edge and a bottom edge to a lower section of a left side edge of the bag body;

a fastening ring is disposed at a lower middle section of the front piece of the bag body for attaching the fastening hook when drawn downwards;

a little pocket disposed at a lower middle section of the front piece, having a little zipper set engaged around four edges thereof and a first adhesive belt corresponding and fastened to a second adhesive belt disposed on the bag body, along with a holding ear at an interior upper middle side; said little pocket being closeable by the little zipper set so as to store the bag body for easy carrying;

whereby, the bag body when not stored in the reversible pocket has a double function of being convertible and supportable by said pair of belts as the shoulder bag or the dress.

* * * * *